United States Patent [19]

Kwon et al.

[11] Patent Number: 5,041,759

[45] Date of Patent: Aug. 20, 1991

[54] COLOR DISCHARGE DISPLAY PANEL

[75] Inventors: Ki-duk Kwon; Jeong-hye Kim, both of Seoul, Rep. of Korea

[73] Assignee: Samsung Electron Devices Limited, Seoul, Rep. of Korea

[21] Appl. No.: 397,876

[22] Filed: Aug. 24, 1989

[30] Foreign Application Priority Data

Jul. 28, 1989 [KR] Rep. of Korea ..... 89-10752

[51] Int. Cl.[5] ..... H01J 17/49

[52] U.S. Cl. ..... 313/495; 313/497; 313/581; 313/582; 313/584; 313/585; 313/586; 313/587; 313/609; 313/610

[58] Field of Search ..... 313/495, 497, 581, 582, 313/584–587, 609, 610

[56] References Cited

U.S. PATENT DOCUMENTS 4,423,352 12/1983 Miyazaki et al. ..... 313/584

FOREIGN PATENT DOCUMENTS 137537 5/1989 Japan ..... 313/582

*Primary Examiner*—Donald J. Yusko
*Assistant Examiner*—Michael Horabik
*Attorney, Agent, or Firm*—Watson, Cole, Grindle & Watson

[57] ABSTRACT

A color discharge display panel is disclosed in which cathodes and anodes are arranged on the upper face of a rear plate, stripe shaped insulating layers forming a matrix form together with the anodes are disposed at the bottoms of the cathodes, and separating ribs and barriers having a lower height are respectively disposed at the opposite edges of the insulation layers. Due to the barriers disposed between the cathodes and anodes, the discharge channels are formed in a round-about form, and consequently, the length of the discharge channel per volume of the discharge space is maximized, with the result that the thickness of the panel becomes thinner compared with that of the conventional panel, and that the realization of a high luminance picture is made possible due to the high discharge efficiency.

2 Claims, 3 Drawing Sheets

COLOR DISCHARGE DISPLAY PANEL

FIELD OF THE INVENTION

The present invention relates to a color discharge display panel, and in particular to a plasma display panel in which positive column is prolonged for improving the optical efficiency and luminance.

BACKGROUND OF THE INVENTION

Plasma display panels have been used mainly as display units for office equipment, but such panels have recently been developed for use as substitutes for the cathode ray tubes. They overcome many of the disadvantages of cathode ray tubes and unlike cathode ray tubes, they provide flat screens. Plasma display panels (to be called hereinafter PDPs) are classified into AC and DC types depending on the discharge method, and are also classified into monochrome and color types, depending on the existence/absence of colors in the display of the picture like cathode ray tubes. Unlike the PDPs in which a discharge light between electrodes constitute a resolved element, i.e., a pixel of the displayed picture, a color PDP uses the discharge light as the exciting (energizing) energy for the phosphor. In the case of such a color PDP, in order for the phosphor to be excited with a sufficient optical efficiency, a sufficient distance between the electrodes should be maintained, that is, the thickness of the panel should be more thickly formed compared with a monochrome PDP.

Among the recently developed color PDPs, the PDP disclosed by Korean Patent Publication No. 79-1795 will be briefly described below. As shown in FIGS. 1 and 2, a front plate 10 and a rear plate 14 are fixedly combined keeping an optimum gag there between by means of separating ribs 12, cathodes 15 are arranged on the inner face of the rear plate 14 in a stripe pattern , anodes 11 are arranged on the inner face of the front plate 10 in the same direction as that of the separating ribs 12, and the separating ribs 12 for preventing cross talks are clad with phosphorescent layer 13.

In such a conventional PDP constituted as described above, upon supplying of a signal current to the anode 11 and the cathode 15, a main discharge occurs, and during this process, the phosphorescent layer 13 is excited by the main discharge light so that the layer 13 will emit color beams. The phosphorescent layer 13 is excited mainly by a positive column emitted by the anode 11, because the luminous flux of the positive column is much larger than that of the negative glow, and is large enough to excite the phosphorescent layer 13. Therefore, in order for the phosphor medium to be excited with a sufficient energy, a positive column having a sufficient intensity is required, and therefore, the anode 11 and the cathode 15 be separated to a large gap, thereby increasing the thickness of the PDP.

SUMMARY OF THE INVENTION

Therefore it is the object of the present invention to provide a color plasma display panel of limited thickness yet providing a high and luminance efficiency.

In achieving the above object, the color discharge display panel according to the present invention comprises: stripe shaped cathodes and anodes arranged in a matrix form between a front plate and a rear plate to form discharge spaces of a certain dimension; separating ribs for preventing cross talks and formed in a certain height and in parallel with the cathodes; and phosphorescent layers provided in the respective independent discharge regions partitioned by the separating ribs, characterized in that the cathodes and the anodes are arranged on the rear plate in such a manner that stripe type insulating layers forming a matrix form together with the anodes are arranged at the bottoms of the cathodes and that the separating ribs and barriers having lower heights are respectively provided at the opposite edges of the insulating layers.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENTS

Figure 1:
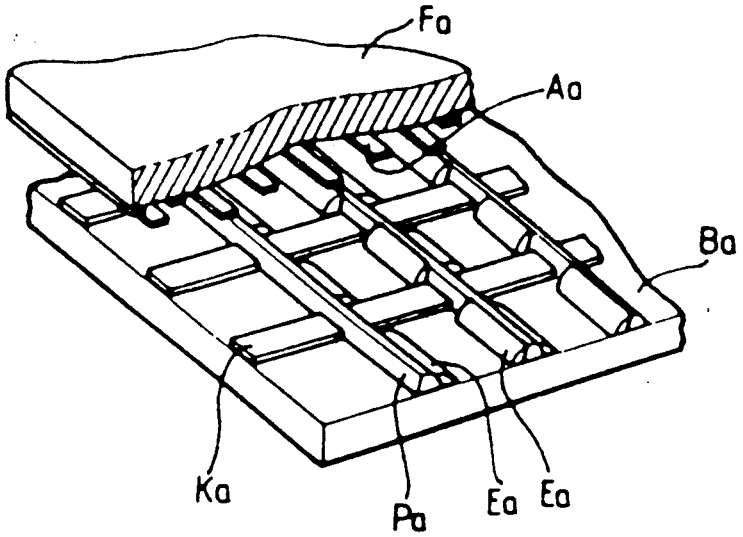
FIG. 1 is a broken away perspective view of a conventional color discharge display panel.
Figure 2:
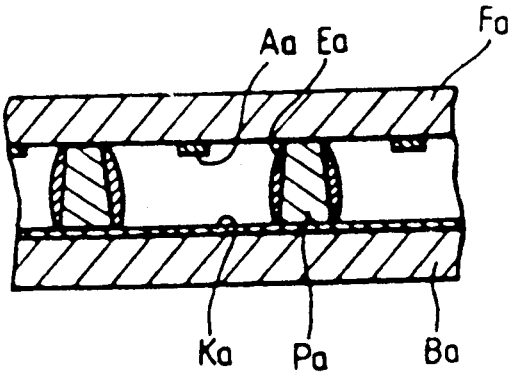
FIG. 2 is a sectional view of the color discharge display panel of FIG. 1.
Figure 3:
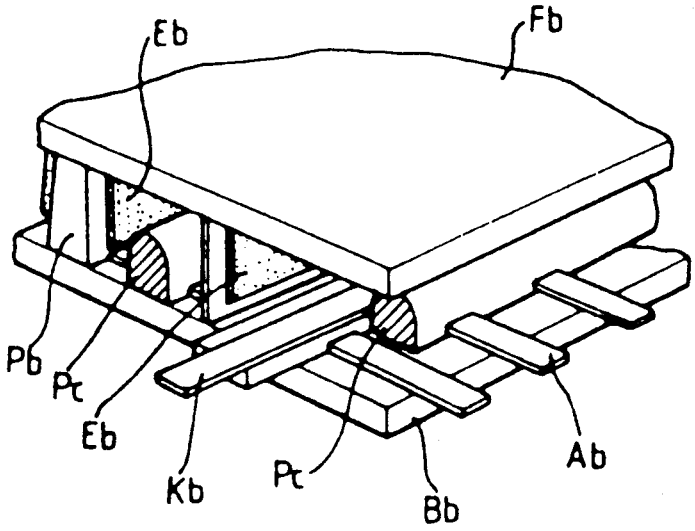
FIG. 3 is a broken away perspective view of a preferred embodiment of the panel according to the present invention.
Figure 4:
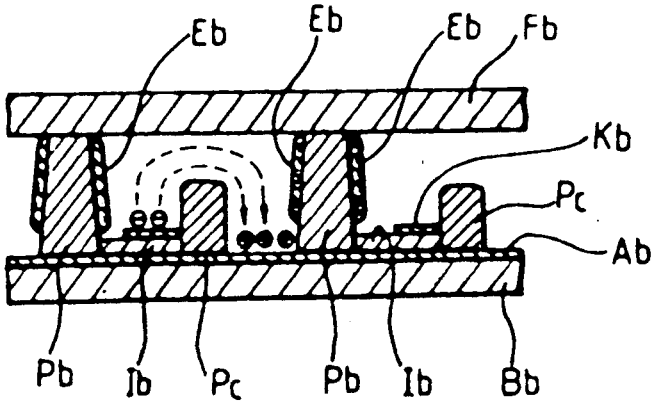
FIG. 4 is a sectional view of the panel of FIG. 3.

As shown in FIG. 3, a plurality of anodes 21 are arranged in a stripe pattern on the inner face of a rear plate 25, being extended in the Y-direction and separated in the X-direction, while a plurality of separating ribs 23 are arranged abutting on the inner surface of a front plate 20, being extended in the X-direction and being separated in the Y-direction. Between the separating ribs 23, barriers 27 having lower heights than the separating ribs 23 are disposed in parallel with the separating ribs 23, while insulating layers 28 are disposed in a stripe shape on the tops of the anodes 26 to one side of the barriers 27. Meanwhile, phosphorescent layers 24 are provided on the both sides of the separating ribs.

In the device of the present invention constituted as described above, it is desirable that the gaps between the anodes 26 and the cathodes 29, i.e., the discharge distances are made to be as long as possible in the respective independent discharge spaces formed between the separating ribs 23. But at the positions where the cathodes 29 and the anodes 26 intersect each other, the insulating layers 28 are disposed with their edges closely contacted with the separating ribs 23 and the barriers 27, and therefore the discharges occur through the portions where the insulating layers 28 are not provided. In other words, the discharge channels are formed in a curved type, or in a round-about bridge type around the barriers 27. That is, the discharges do not occur through straight channels, but occur through U-shaped channels, with the result that the positive columns are lengthened to contribute to exciting the phosphorescent layers, thereby making it possible to excite the phosphorescent layers with greater intensity and a greater discharge efficiency.

Figure 5:
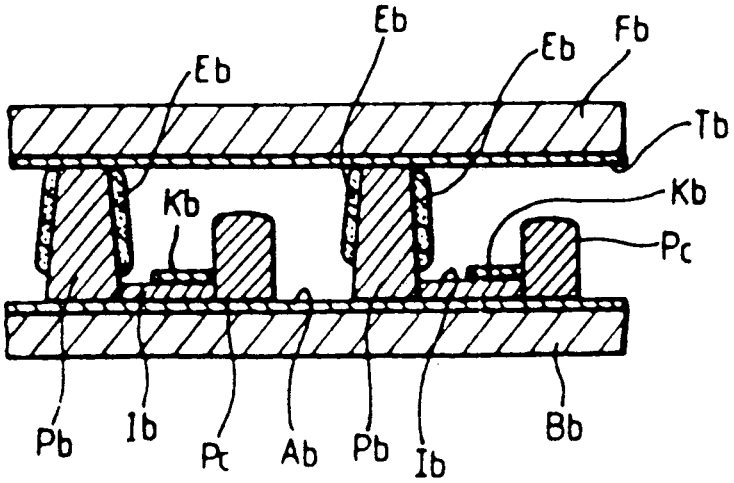
FIG. 5 is a sectional view of another embodiment of the panel according to the present invention.

FIG. 5 illustrates another embodiment according to the present invention, and this is a color discharge display panel based on the plasma discharge method and having trigger electrode, the trigger electrode 21 being arranged on the inner face of the front plate 21 in the same direction and at the same intervals as the anodes 26*a*.

PDP provided with trigger electrodes is driven by applying current as usual. Initially, upon applying a trigger signal to the cathodes 29*a* and the trigger electrodes 21, auxiliary discharge occurs along the vertical straight path. Then, upon applying current of high voltage to the anodes, main discharge occurs along the curved roundabout path over the barriers 27*a*. Therefore, during the main discharge, each of the phosphorescent layers 24*a* coated on the separating ribs 23*a* is excited and radiates.

As described above, according to the present invention, the cathodes and the anodes are arranged in a matrix form on the rear plate so as for the discharges to occur in a direction parallel to the rear plate, and the barriers are provided between the cathodes and the anodes so as for the discharge channels to be formed in round-about shapes. Consequently the length of the discharge channel per volume of the discharge space is maximized, with the result that the thickness of the paned becomes thinner compared with that of a conventional color discharge display panel, and that the realization of a high luminance picture is made possible due to the high discharge efficiency.

The device according to the present invention can be applied not only on the plasma display panels as described above, but also on glow discharge display panels. Meanwhile, the device of the present invention can be modified in its auxiliary constitutions depending on the existence/absence of a dielectric layer and trigger electrodes, but it should be understood that all such modifications come within the scope of the present invention as long a they are based on the technical conception of the present invention as recited in the appended claims.

What is claimed is:

1. A color discharge display panel which comprises:

a front plate and a rear plate positioned in register with one another, said front and rear plates being spaced apart a predetermined distance, said front plate having an inner surface facing said rear plate and said rear plate having an inner surface facing said front plate, a plurality of parallel, stripe-shaped cathodes arranged in on the inner surface of said rear plate, a plurality of parallel ribs perpendicularly positioned with respect to said cathodes and extending between said front plate and said rear plate, each adjacent pair of ribs defining a discharge region therebetween, a barrier located between each pair adjacent ribs and extending in parallel therewith, each barrier extending from the inner surface of said rear plate toward said inner surface of said front plate, an insulating layer covering the inner surface of said rear plate and associated cathode portions between each barrier and a first of the ribs of the pair of ribs between which the barrier is located, a stripe shaped anode formed on a surface of each insulating layer facing said front plate, and a phosphorescent layer having a predetermined color located in the discharge region between each pair of ribs, said phosphorescent layer illuminating with a generally U-shaped discharge occurring over each barrier in each discharge region from the anode therein to the cathode portions between each barrier and a second of the ribs of the pair of ribs between which the barrier is located.

2. A panel according to claim 1, further including a plurality of parallel, stripe-shaped trigger electrodes located on the inner surface of said front plate and perpendicularly oriented with respect to said strip-shaped cathodes.

* * * * *